US005647910A

United States Patent [19]

Brown

[11] Patent Number: 5,647,910

[45] **Date of Patent: *Jul. 15, 1997**

[54] APPARATUS FOR DELIVERING LOOSE FILL PACKAGING MATERIAL AND APPLYING AN ADDITIVE THERETO

[75] Inventor: Daniel P. Brown, Palos Park, Ill.

[73] Assignee: The Dow Chemical Company, Midland, Mich.

[ * ] Notice: The term of this patent shall not extend beyond the expiration date of Pat. No. 5,236,507.

[21] Appl. No.: 472,728

[22] Filed: Jan. 31, 1990

[51] Int. Cl.[6] ..... B05C 5/00

[52] U.S. Cl. ..... 118/710; 118/303; 118/317

[58] Field of Search ..... 118/303, 317, 118/707, 710; 239/112, 113, 414, 416.5, 528, 662

[56] References Cited

U.S. PATENT DOCUMENTS

| | | | |
|---|---|---|---|
| 1,849,945 | 3/1932 | Mobley et al. | 118/303 |
| 2,929,436 | 3/1960 | Hampshire | 118/303 |
| 3,038,482 | 6/1962 | Mylting et al. | 118/303 |
| 3,292,859 | 12/1966 | Landon | 239/9 |
| 3,938,469 | 2/1976 | Nau | 118/303 |
| 3,976,030 | 8/1976 | Ragsdale et al. | 118/303 |
| 4,588,638 | 5/1986 | Dolinar | 428/339 |
| 4,644,733 | 2/1987 | Dolinar | 53/472 |

FOREIGN PATENT DOCUMENTS

| | | | |
|---|---|---|---|
| 1123563 | 11/1984 | U.S.S.R. | 118/303 |
| 919994 | 2/1963 | United Kingdom | 118/303 |

OTHER PUBLICATIONS

"Combining the economies of loose fill with the protection of engineered, molded cushions"–The Dow Chemical Company, Mar. 1986, Form No. 172–9647–86.

"Pelaspan Mold–a–pac Packaging Products"–The Dow Chemical Company, Sep. 1985, Form No. 172–9642–85.

"Williams–Sonoma Cuts Prepackaging Costs in Hald With Pelaspan Mold–A–Pac Packaging Products"–The Dow Chemical Company, Form No. 172–9663–87.

*Primary Examiner*—Laura Edwards

*Attorney, Agent, or Firm*—Wood, Phillips, VanSanten, Clark & Mortimer

[57] ABSTRACT

A method and apparatus for controllably delivering discrete loose fill dunnage particles from a supply to a packaging site and for applying an additive to at least a portion of an exposed surface on a plurality of particles to cause abutting particles to adhere to each other. The apparatus consists of: a conduit having an inside wall surface defining a conveying path for loose fill particles, an inlet end communicating with the loose fill particle supply, and an outlet end for discharging loose fill particles conveyed from the supply through the conduit to the packaging site; a nozzle for producing a shower of additive through which a plurality of loose fill particles conveying between the supply and the packaging site pass; and structure for delivering a pressurized additive through the nozzle so that the additive is directed by the nozzle in a pattern adjacent to the outlet end of the conduit.

21 Claims, 5 Drawing Sheets

APPARATUS FOR DELIVERING LOOSE FILL PACKAGING MATERIAL AND APPLYING AN ADDITIVE THERETO

BACKGROUND OF THE INVENTION

1. Field of the Invention

This invention relates to on-site loose fill packaging and, more particularly, to an apparatus for controllably delivering discrete loose fill particles from a supply to a packaging site and for applying an additive to the loose fill particles to cause the loose fill particles to adhere to each other.

2. Background of the Invention

Packaging of articles for safe shipping and handling is a critical part of virtually all businesses that deal in fragile goods. Those in the packaging industry strive to achieve two, oft times competing, objectives—that of producing low cost packaging that is effective in minimizing breakage/damage of product. Packaging costs become highly critical for goods with low profit margin. As a result, over the years, the packaging industry has become increasingly competitive.

There are presently three primary methods of packaging fragile items—"foam in place", "loose fill", and custom fabricated foam shape packaging. The foam in place technique employs two reactive chemicals which are measured and interacted to instantly produce a low density packaging foam. The foam is directed into article-carrying containers on-site and expands within the constraints of a container to surround, and thereby provide a cushion for, articles within the container.

There are many drawbacks with this packaging technique. The chemical reactants are hazardous. Care must be exercised to protect the system operators. Proper ventilation is recommended in plants and often requires modification to existing systems. Because the polymerization is taking place on-site, the reaction gases, even when vented, tend to pollute the plant environment. Discharge of waste chemical components, and containers therefor, must also be contended with. Further, foam in place packaging cannot be practiced with articles that are heat sensitive because the reaction of components is exothermic. A further drawback with foam in place systems is that the environment therearound is very difficult to keep clean. A still further problem with foam in place systems is that the equipment for processing the same is relatively complicated and requires periodic maintenance. Poorly maintained metering and mixing equipment may produce improper component ratios which minimizes yield and compromises the integrity of the foam end product.

While the foam in place industry has thriven, the above problems have been contended with. The adhesive coated loose fill packaging technique obviates many of the above problems and is, in many applications, a preferred alternative to foam in place.

To produce loose fill, resin material is expanded in bulk by converters worldwide. The resulting expanded particles, referred to commonly in the industry as "peanuts", are shipped in bulk from the converters to individual customers.

Loose fill packaging operations typically gravity feed the discrete, expanded, polystyrene particles into a container for an article to be shipped. At customers' facilities, the peanuts are stored in bulk supply hoppers and normally fed through a depending, flexible conduit which is controlled by the operator to direct a desired amount of the loose fill into a container in which an article is to be shipped. It is known in the art to discharge loose fill into the bottom of an empty container, place an article to be shipped thereover and then cover the article with a further supply of the loose fill.

Product migration within the loose fill is a problem. This is caused by vibrational settling of the product in the carton due to the continued package vibration encountered in the shipping environment. Also, damage caused by abrupt movement or impact to the package is costly to the shipper.

To improve the loose fill cushioning potential and to prevent this migration, The Dow Chemical Company devised a method of coating the particles with an additive/adhesive that bonds the particles to each other to effectively produce, once the additive cures, a solid cushioning block of loose fill particles. The packaging method and additive/adhesive invented by The Dow Chemical Company are described fully in U.S. Pat. Nos. 4,588,638 and 4,644,733, both issued in the name of Dolinar, and assigned to The Dow Chemical Company.

The Dow Chemical Company also has a loose fill dispensing control valve and additive applicator system which it currently markets under its trademark PELASPAN MOLD-A-PAC™. The Dow Chemical Company has been the leader in the loose fill industry and its equipment is considered to be representative of the state of the art. The following is a brief description of The Dow Chemical Company's equipment that is currently being used in the industry.

Heretofore, it was believed important to substantially completely coat virtually all of the individual loose fill particles with additive/adhesive to produce an effective package for fragile goods. To accomplish this, a plurality of nozzles are arranged around the periphery of the loose fill discharge conduit and direct pressurized additive/adhesive towards the center of the conduit. The mixing spray patterns develop a tumbling action on the particles in the adhesive/additive shower, which results in a fairly thorough coverage. Individual solenoid valves are associated with each nozzle and are operated through a central, electromechanical controller which also dictates the opening and closing of a valve to coordinate loose fill discharge with the nozzle operation.

The above system has several drawbacks. First, an excessive amount of adhesive is intentionally delivered through the nozzles to assure that the particle coverage is complete. A pressurized supply of the additive/adhesive impinges on the inside conduit wall at a location that is sufficiently above the bottom of the conduit that the particles can be repeatedly tumbled before falling out of the conduit.

Excess additive/adhesive that drips down the conduit must be collected and dryed by a separate dryer system for subsequent disposal. Over time there is a progressive buildup of the adhesive on the inside surface of the conduit. This buildup occurs sufficiently high above the bottom of the conduit that gaining access thereto is difficult. At a minimum, daily flushing is required. This produces a large quantity of flushed adhesive waste. Disassembly of the entire structure for purposes of cleaning may also be necessitated even with regular flushing.

A further problem with the above system is that there is sufficient thickness of the additive/adhesive on the particles that it takes a considerable length of time to cure. The completed packages must remain in a relatively stationary state until the additive/adhesive cures. The problem of monitoring curing time and storing the packages to be cured is obvious.

A further drawback with the above system is that the electromechanical control unit is relatively complicated and resultingly relatively expensive to manufacture, install and maintain/repair. The latter two operations may require a skilled technician. Further, complicated electromechanical controls are inherently more prone to failure than are their simpler mechanical counterparts. Because additive delivery, flushing and loose fill delivery are all coordinated through the electromechanical control, failure of any part of the control may disable the whole system and result in lengthy system down time.

Because of the large amount of additive that is applied to the loose fill particles, the collected overfill of treated particles is subjected to heat from a 220 volt device to speed up the drying of the additive/adhesive so that the coated particles can be recycled in a reasonably short time. This contributes further to the complication and cost of the system.

A further drawback with the above system is that the intricate flow network for the additive delivery requires a relatively lengthy flushing period.

SUMMARY OF THE INVENTION

The present invention is specifically directed to overcoming the above-enumerated problems in a novel and simple manner.

The present invention is directed to an apparatus for controllably delivering discrete loose fill dunnage particles from a supply to a packaging site and for applying an additive to at least a portion of an exposed surface on a plurality of particles to cause abutting particles to adhere to each other. The apparatus consists of: a conduit having an inside wall surface defining a conveying path for loose fill particles, an inlet end communicating with the loose fill particle supply, and an outlet end for discharging loose fill particles conveyed from the supply through the conduit to the packaging site; a nozzle for producing a shower of additive through which a plurality of loose fill particles conveying between the supply and the packaging site pass; and structure for delivering a pressurized additive through the nozzle so that the additive is directed by the nozzle in a pattern adjacent to the outlet end of the conduit.

Preferably, the additive shower is in a pattern that is umbrella-/cone-shaped so that at least part of the spray is propelled directly through the outlet end of the conduit and into a container therebeneath, which is being filled.

With the inventive structure, additive is applied directly to the conveying particles and a further amount of additive is applied to the particles which come to rest in the container.

The invention also contemplates, among other spray patterns, the development of a flat layer of adhesive across the conduit at substantially right angles to the loose fill particle flow direction.

A further advantage of the above arrangement is that, in use, the additive does not build up appreciably on the conduit. Preferably, if the additive spray pattern does impinge on the conduit, the contact of the additive with the conduit occurs within approximately 6 inches of the bottom of the conduit so that the same is readily accessible to be cleaned through the open, bottom end of the conduit. It is also within the scope of the invention to cause substantially the entire spray pattern to impinge on the inside surface of the conduit, adjacent the bottom end thereof.

The invention contemplates that the additive/adhesive discharge through the nozzle be coordinated with the flow of loose fill. A flow control valve is provided in the conduit at a location above the nozzle in gravity feed systems. Loose fill flow and additive/adhesive discharge are coordinated so that as the valve on the conduit moves to an open state to allow flow of loose fill, additive/adhesive is caused to discharge through the nozzle.

Preferably, the nozzle is located centrally of the conduit and directs the pressurized additive/adhesive toward the inside peripheral wall of the conduit. In a preferred form, there is one and only one nozzle, although the use of more than one nozzle is also contemplated by the invention. The nozzle preferably has a curved wall with a plurality of openings/orifices therein to produce a fan-like spray that either extends across the conduit as a flat layer or bends down under the influence of gravity. Preferably, through openings/orifices are provided in the nozzle wall and are equidistantly spaced around the periphery thereof so that a continuous, circular spray pattern is developed about the nozzle. Alternatively, a single downwardly opening orifice can be used to produce an inverted cone-shaped pattern. Other arrangements of orifices are contemplated by the invention.

Unexpectedly, it has been found that production of what is effectively a single layer of the additive results in sufficient coating of the particles. A significantly lesser amount of additive is needed than with conventional systems employing multiple nozzles. In testing, the inventive device used less than 50% of the adhesive used by the above-described prior art device. At the same time, the drying time for the additive on the particles is significantly reduced, which is obviously beneficial to the packaging institution.

Further, there is no need, with the inventive system, to accumulate and recycle excess additive/adhesive. Virtually all of the discharged additive adheres to the conveying particles or is directed into the container.

Still further, the additive on any collected overfill of loose fill particles dries rapidly. Also, the need for expensive heaters to speed drying of the flushed adhesive is unnecessary.

Still further, the single nozzle arrangement facilitates system flushing. All flushing fluid/water pressure can be concentrated through a single nozzle. Due to the simple nature of the piping to the nozzle, the flushing can be performed in a matter of seconds, with a minimal amount of flush waste. Also due to the fact that the internal walls of the conduit need not be cleaned, daily flushing is not necessary. If the operator cleans and covers the spray nozzle apertures to prevent exposure thereof in the air, daily flushing may not be necessary. This greatly reduces the inconvenience and cost of maintenance.

A further advantage of the present invention is that a loose fill flow control valve, which is located above the additive spray pattern, to avoid contact therewith, can be located near the conduit outlet. This gives prompt shut off response, whereas, in the prior art systems, a considerable amount of loose fill on the conduit below the loose fill control valve discharges after the valve is shut off. This accounts for less overfilling of packages due to an operator's misjudging of the package volume.

DETAILED DESCRIPTION OF THE DRAWINGS

Figure 1:
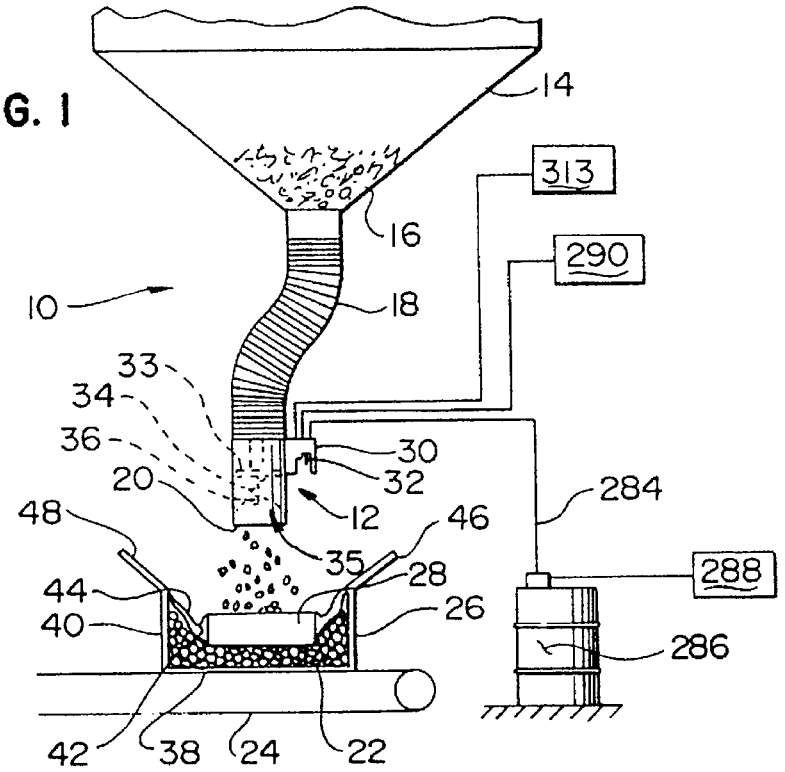
FIG. 1 is a side elevation view of an on-site packaging system including a bulk supply of loose fill for feeding through a conduit on which a loose fill flow control/adhesive applying system, according to the present invention, is incorporated.
Figure 3:
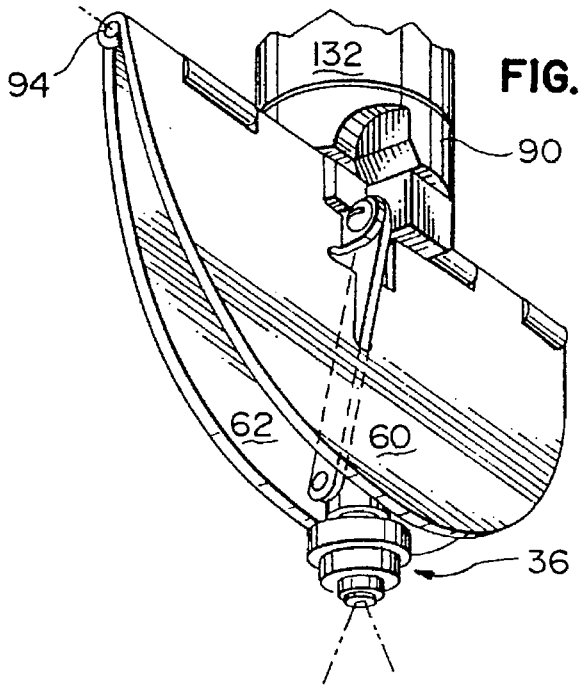
FIG. 3 is an enlarged, perspective view of a loose fill flow control valve according to the present invention.

In FIG. 1, an exemplary on-site loose fill packaging system is shown at 10 with a loose fill delivery control/additive applicator according to the present invention incorporated therein at 12. Briefly, the system 10 has a hopper 14 containing a supply of loose fill dunnage material 16 which is funnelled toward the bottom of the hopper 14 into a conduit 18, on the order of eight inches in diameter, and having an open bottom end 20 through which the loose fill material 16 discharges. The loose fill material 16 consists of discrete particles 22 (see FIGS. 2 and 4) which are preferably polystyrene expanded shapes, commonly referred to in the industry as "peanuts". The system 10 includes a conveyor 24 which advances containers/cartons 26 one by one into a filling position directly beneath the hopper 14 and discharge end 20 of the conduit 18.

In preparing an article 28 for shipping in the container 26, a limited amount of the loose fill particles 22 is introduced to the open container 26. This is facilitated by the delivery control/additive applicator 12 of the present invention. A pistol-type grip/handle 30 is fixedly attached to the conduit 18 adjacent the bottom end 20 thereof and can be conveniently grasped by the operator to control the position of the discharge end 20 of the conduit 18 with respect to the container 26. By operating a trigger 32 on the grip 30, separately movable valve wings 33, 34 are repositioned to allow free flow of the loose fill 16 through the conduit 18 and out the discharge end 20 thereof and into the container 26. At the same time that the valve wings 33, 34 are opened, an additive shower 35 is developed through a nozzle assembly 36 within the conduit 18. The loose fill particles 22 conveying downwardly beyond the valve wings 33, 34 pass through the additive shower. The additive causes the individual particles 22 to adhere to each other to create a formed void filling block of the particles 22 within the container 26. This limits the tendency of the particles 22 to separate from each other and resultingly the article 28 surrounded thereby to migrate through the loose fill 16, as during shipping and handling.

The initial charge of loose fill 16 into the container 26 provides a bed for the article 28 and a cushion layer between the article 28 and the container bottom wall 38 and peripheral, upstanding wall 40.

To protect the article 28 from the additive, a thin sheet 42 of pliable plastic is placed over the loose fill 16 at the bottom of the container 26. The article 28 is then nested in the bed of loose fill 16 after which a second protective plastic sheet 44 is placed over the article 28. A further amount of loose fill 16 is directed into the container 26 so that the container 26 is slightly overfilled. Container flaps 46, 48 are then closed and pressed downwardly to compress the loose fill material 16 which then surroundingly embraces the article 28 on all sides thereof.

Once the additive is cured, the article 28 remains firmly planted within the container 26 with a conforming cushion of loose fill 16 entirely therearound. At the point of use, access can be gained to the article 28 by simply drawing the upper sheet 44 out of the container 26 and removing with the sheet 44 the solid block of loose fill 16 disposed thereover. The sheets 42, 44, which provide an interface between upper and lower blocks of loose fill 16, do not adhere to each other and thus the sheet 44 is readily separable. With the sheet 44 removed, the article 28, which is not contacted by the additive, is exposed and can be separated from the underlying loose fill 16.

The present invention is directed to the control/applicator 12 which applies additive/adhesive to the conveying loose fill particles 22 and coordinates the discharge of the loose fill particles 22 with the additive application.

The control/applicator 12 of the present invention, as seen in FIGS. 1–7, consists of four subassemblies: 1) a loose fill flow control valve subassembly with a fluid discharge nozzle 52; 2) a fluid control valve subassembly 54 for additive and flushing fluid; 3) a combination conduit positioning handle and actuator subassembly 56 for the loose fill and fluid control valves 50, 54; and 4) a transition block subassembly 58 for operatively connecting the valve subassembly 54 and handle/actuator subassembly 54 to the conduit 18 and each other.

Loose Fill Flow Control Valve/Nozzle Subassembly (50)

Figure 2:
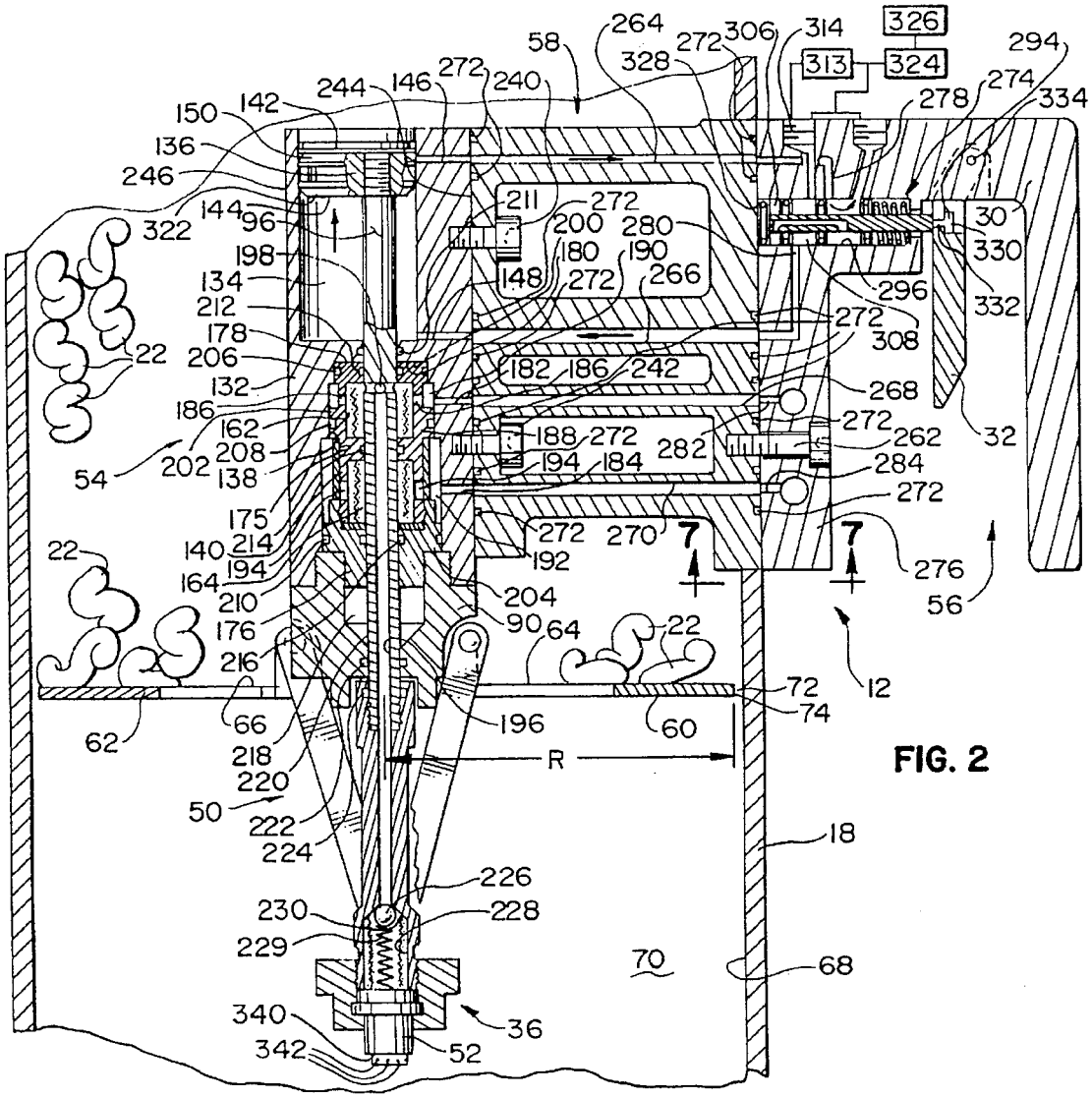
FIG. 2 is an enlarged, cross-sectional view of a flow control/adhesive applying system, according to the present invention, with the system in a shut off/flushing mode.
Figure 4:
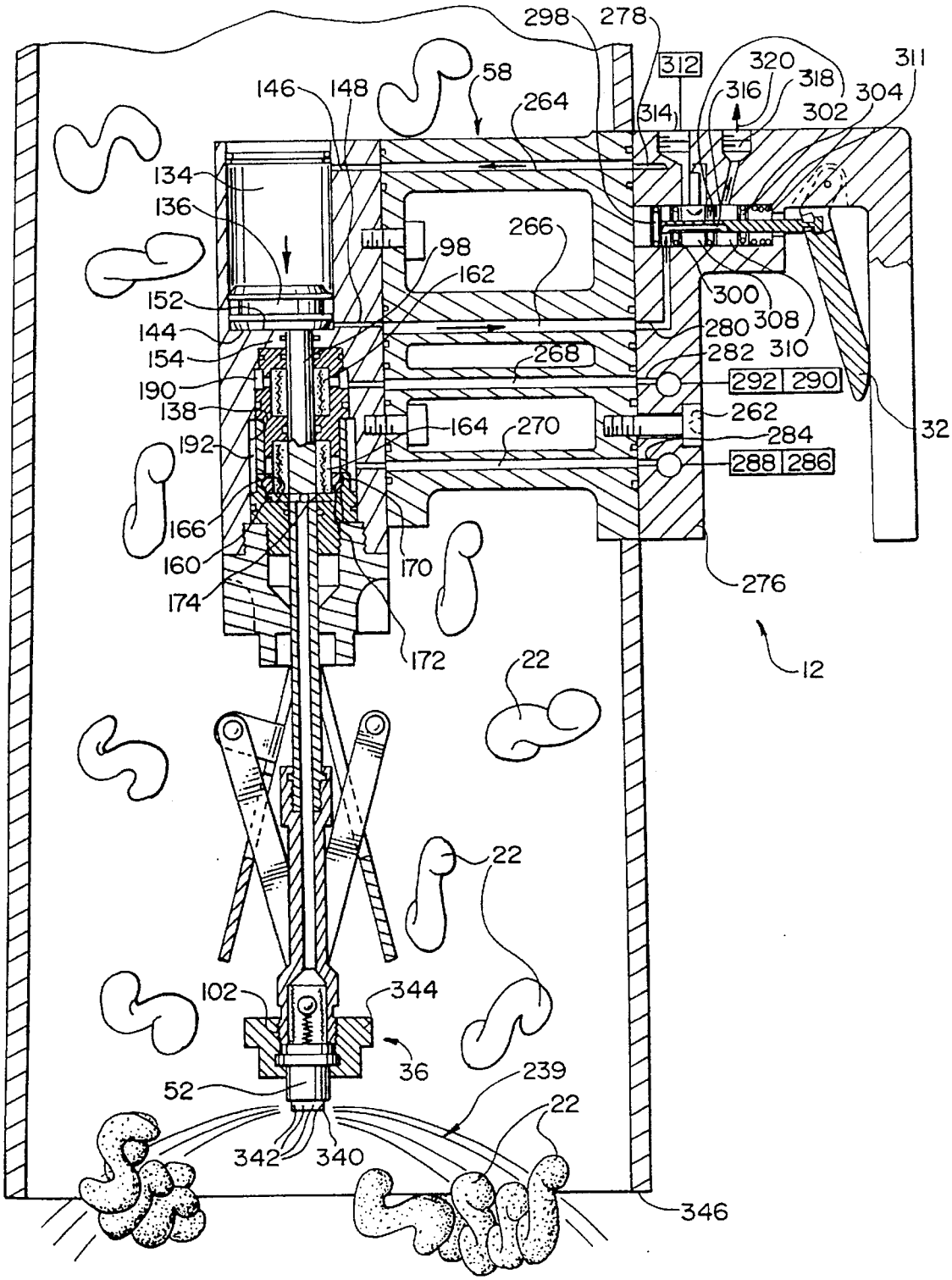
FIG. 4 is a view similar to that in FIG. 2 with the inventive system in a loose fill discharge mode.

The loose fill flow control valve 50, which is the subject of a co-pending application in my name, is movable between a closed position, shown in FIG. 2, and an open position, shown in FIG. 4. In the closed valve position of FIG. 2, first and second flat metal valve wings 60, 62 are situated so that flat blocking surfaces 64, 66, respectively thereon, are substantially coplanar and span substantially the entire cross section of the conduit 18. The conduit 18 shown in the drawings has an inside surface 68 defining a flow passageway 70 that has a circular cross section. It is not necessary, however, that the cross section of the passageway 70 be circular.

The effective radius R (FIG. 2) of the combined planar surfaces 64, 66 is slightly less than the radius of the inside surface 68 of the conduit 18. This affords a slight gap 72 between the peripheral edge 74 of the wings 60, 62 and the conduit inner surface 68 so that there is no interference therebetween as the valve wings 60, 62 are repositioned in operation.

To mount the wings 60, 62 for pivoting movement, the wing 60 has integrally formed knuckles 76, 78, 80 and the wing 62 corresponding knuckles 76', 78', 80'. The wings 60, 62 are identical, and thus the corresponding parts will be identified with the same reference numerals with a "'" used on the elements of valve wing 62. The knuckles 76, 78, 80, 76' 78', 80' are intermeshed so that they cooperatively define a barrel 82 for separate hinge pins 84, 86. Hinge pin 84 extends consecutively through knuckles 76, 80' and 78 and into a blind bore 88 in a valve cap 90 for the subassembly 54. The other hinge pin 86 extends consecutively through knuckles 76', 80 and 78' and into a blind bore 92 coaxial with the bore 88 so that the valve wings 60, 62 pivot about the same axis 94 relative to the valve cap 90.

In operation, the valve wings 60, 62 are simultaneously movable in opposite directions about the pivot axis 94 between their open and closed positions. This movement is effected through a reciprocating two-part actuating rod/shaft 96. The upper rod part 98 is integral with the subassembly 54 and removably, threadably connects to the lower rod part 100. The lowermost part 102 of the rod part 100 accepts the dispensing nozzle assembly 36. The bottom end 104 of the rod part 98 is threaded into the upper end 106 of the rod part 100. With the subassemblies 50, 54 operatively connected, the rod parts 98, 100 act as a unit that reciprocates in a vertical line. The reciprocation of the rod part 98 is effected through the subassembly 54 as hereafter described.

The rod part 100 connects to the valve wings 60, 62 through links 108, 110, which convert vertical linear movement of the rod part 100 into pivoting movement of the valve wings 60, 62. The link 108 extends through a cut-out 112 in the valve wing 60 and has one end 114 that pivotably connects to a tab 116 struck directly from the valve wing 60 and bent at right angles to the plane of the blocking surface 64. A screw/bolt 118 pivotably connects the link end 114 to the tab 116. The other link end 120 is pivotably connected to an enlargement 122 on the rod part 100 through a screw 124. The link 110 is similarly connected to the valve wing 62. The link end 126 connects to a tab 128 on the wing 62 and the opposite link end 130 pivotably connects to the enlargement 122 on the rod 96. A cut-out 112' in the wing 62 accommodates the link 110. The cut-outs 112, 112', in addition to accommodating the links 108, 110, also provide an opening to accept the valve cap 90, which is in axial coincidence with the plane of the valve wings 60, 62, with the valve 50 in the closed position of FIG. 2.

With the actuating rod 96 in its uppermost position, as shown in FIG. 2, the valve wings 60, 62 are in their closed position. As the rod 96 extends downwardly, the rod part 100 draws the links 108, 110 to pivot the wings 60, 62 oppositely about the pivot axis 94, collapsing the wings 60, 62 downwardly upon themselves to open up the flow passageway 70 for the loose fill material 16.

Closing of the valve wings 60, 62 causes the wings 60, 62 to simultaneously pivot upwardly and thereby sweep upwardly conveying loose fill. Prompt shut off response results, particularly with the valve wings 60, 62 in close proximity to the bottom of the conduit, as is a preferred location.

Fluid Control Valve Subassembly for Additive and Flushing Fluid (52)

The position of the actuating rod 96 is dictated by the fluid valve subassembly 54 which, in turn, is controlled by the handle/actuator subassembly 56. The fluid valve subassembly 54 has a cylindrical casing 132, preferably of metal, defining a cylinder 134 for a piston 136 and a chamber 138 for a replaceable valve cartridge 140.

The position of the piston 136 is controlled by varying the pressure of a fluid, preferably air, on the opposite faces 142, 144 thereof. Bores 146, 148 extend radially through the wall of casing 132 to communicate with the cylinder 134 at the top and bottom thereof, respectively. The bores 146, 148 serve alternatingly as delivery and relief conduits, as dictated by the operator through the handle/actuator subassembly 56.

When pressurized air is delivered through the bore 148, the piston 136 is forced upwardly and the air above the piston 136 exhausted through the bore 146. This action draws the actuating rod 96 upwardly to close the valve wings 60, 62. With the pressurized fluid introduced through line 146, the air impinges against the chamfered edge 150 of the piston 136 to drive the piston 136 downwardly, as shown in FIG. 4. As this occurs, the actuator rod 96 is forced downwardly to collapse the valve wings 60, 62 into the open position therefor. The bottom piston face 144 abuts the upwardly facing surface 152 on a dividing wall 154 between the piston chamber 134 and the cartridge chamber 138 to limit the downward stroke of the piston 136.

The cartridge 140 has a three-part construction—cylindrical upper and lower parts 156, 158, preferably of plastic, and a metal scraper ring/washer 160 operatively captured between the upper and lower parts 156, 158. The cartridge 140 defines two internal, cylindrical chambers 162, 164, the former to accommodate a system flushing fluid, such as water, and the latter to accommodate an additive, which is preferably an adhesive material.

It is anticipated that any blockage, due to the accumulation of additive, contaminant, or the like, within the system, would most likely develop in the cartridge 140. Accordingly, it is the objective of the present invention to afford a cartridge 140 that is accessible for replacement and one that can be economically manufactured so that its replacement on-site is cost feasible. The three-part construction for the cartridge 140 facilitates inexpensive manufacture thereof.

The lower cartridge part 158 has an undercut 166 in which the scraper ring 160 nests. With the upper and lower cartridge parts 156, 158 assembled, the lower annular edge 168 of the upper cartridge part 156 engages and captures the scraper ring 160 against the bottom of the undercut 166 on the lower cartridge part 158. An annular bead 170 on the upper cartridge part 156 snaps into a recess 172 on the lower cartridge part 158, with the bead 170 and recess 172 axially aligned, to lock the cartridge parts 156, 158 in operative relationship. The metal scraper ring 160 is dimensioned so that the inside surface 174 thereof, which bounds a bore through which the rod part 98 extends, will scrape off any foreign matter adhering to the rod part 98, as the device is operated.

To assemble the cartridge 140, one need only drop the scraper ring 160 into the seat therefor in the lower cartridge part 158, place the lower end of the upper cartridge 156 into the undercut and force the parts 156, 158 against each other until the bead 170 seats in the recess 172. Consistent assembly of the cartridge 140 is assured. A cylindrical filter 175 is preferably integrated into the cartridge 140 to screen out contaminants in the additive. The filter 175 surrounds the upper cartridge part 156 and is captured between the interconnected upper and lower cartridge parts 156, 158.

The cartridge 140 is affixed to and held in place by the valve cap 90. The bottom end 176 of the lower cartridge part 158 is threadably engaged with the valve cap 90. The valve cap 90 is in turn threadably mated with the valve casing 132 and, in a fully seated position, bears the upper end 178 of the cartridge 140 against the downwardly facing surface 180 of the dividing wall 154.

The thread direction on the cooperating threads on the cartridge 140 and valve cap 90 is different than that for the valve cap 90 and casing 132. This prevents inadvertent separation of the valve cartridge 140 from the valve cap 90 when the valve cap 90 is unscrewed from the casing 132. That is, the valve cartridge 140 will remain intact with the valve cap 90 and can be readily separated from the valve cap 90 after the cap 90 is removed from the casing. The plastic cartridge parts 156, 158 can be inexpensively manufactured. The cartridge 140 can be readily and inexpensively replaced by the operator, thereby obviating time consuming maintenance and lengthy system shutdowns.

With the cartridge 140 operatively positioned, the annular chamber 162 aligns with a radial bore 182 through the casing 132 and the annular chamber 164 aligns with a similar bore 184. A bore 186 extends through the cartridge wall 188 at diametrically opposite locations to establish communication between the chamber 162 and bore 182. The fluid introduced through bore 182 fills an annular reservoir 190, defined cooperatively by the cartridge wall 188 and casing 132, and bleeds therefrom through the bore 186 into the chamber 162.

A similar arrangement exists between the chamber 164 and bore 184. The bore 184 communicates with a reservoir 192 which bleeds fluid/additive through the filter 175 and a bore 194 in the cartridge wall 188 at diametrically opposite locations thereon.

The actuating rod 96, in addition to the function it serves in actuating the valve wings 60, 62, has a lengthwise bore 196 which defines a fluid communication path selectively between a) the chamber 162 and the nozzle 52 and b) the chamber 164 and the nozzle 52. A radially extending feed opening 198 registers vertically with the chamber 162 with the piston 136 in its upwardmost position of FIG. 2 and registers with chamber 164 with the piston 136 in its lowermost position, shown in FIG. 4. In the latter position, the valve wings 60, 62 move into their open position as the feed opening 198 registers with the chamber 164 so that the additive discharges through the nozzle 52 as the loose fill 16 flows downwardly past the valve wings 60, 62.

Several safeguards are incorporated into the design of the subassembly 54. The cartridge 140 has a stepped configuration with three integrally formed, annular beads 200, 202, 204, that progressively increase in diameter from top to bottom. Each bead 200, 202, 204 has an annular undercut to accommodate O-rings 206, 208, 210, consecutively, which seal between the cartridge 140 and housing chamber 138 to prevent undesired migration of the additive/flushing fluid. The casing 132 has a corresponding stepped configuration to allow the beads 202, 204 and O-rings 206, 208 thereon to pass freely through the chamber 138 without interference, into the operative cartridge position, so that the O-rings 206, 208 are not damaged during assembly and disassembly of the valve cartridge 140.

An O-ring 210 surrounding the rod 96 provides a backup seal to O-ring 206 so that fluid in reservoir 190 cannot migrate into the cylinder 134. An O-ring 212 prevents migration of fluid from chamber 162 into the cylinder 134, with O-ring 210 providing a redundant seal. The O-ring 208 prevents communication between the reservoirs 190, 192. An O-ring 214 prevents communication of fluid between the chambers 162, 164. An O-ring 216 prevents communication of fluid between the chamber 164 and a holding reservoir 218.

The reservoir 218 itself affords a fluid barrier. Preferably, the reservoir 218 is filled with a lubricant which coats the outer surface 220 of the rod portion 98 to facilitate smooth reciprocating movement thereof. For fluid to leak through the nozzle 52 from the chamber 164, it would be necessary for that fluid in the chamber 164 to displace the lubricant in the reservoir 218 and pass beyond O-rings 222, 224 and through the threads between the adjoining ends 104, 106 of the rod parts 98, 100, respectively.

Even if the fluid from chamber 164 was able to find its way into the discharge bore 196, a ball 226, associated with a check valve assembly 228 on the nozzle 52, and biased by a coil spring 229 against a seat 230 therefor in the rod part 100, prevents its escape through the nozzle 52.

The Transition Block Subassembly (58)

The transition block subassembly 58 consists of a rectangular body 232 made preferably from ¾" metal stock. Three rectangular cut-outs 234, 236, 238 are made in the body 232 primarily for purposes of weight reduction. The top and bottom cut-outs 234, 238, respectively, permit access to be gained to bolts 240, 242 used to secure the inside edge 244 of the body 232 against the peripheral wall 246 of the casing 132 on the fluid valve subassembly 54. The body 232 has a vertically directed rib 248 which extends through a matched opening 250 in the conduit 18. With the rib 248 extended fully into the conduit opening 250, radially outwardly facing shoulders 252, 254 on the body 232 abut the inside conduit surface 68. The outer edge 256 of the body 232 is configured to be flush with and match the curvature of the outer surface 258 of the conduit 18.

The dimension of the body 232 between the inside edge 244 thereof and shoulders 252, 254 is chosen so that the axes of the cylinder casing 132 and actuating rod 96 are coaxial with the lengthwise axis of conduit 18.

An inwardly facing edge 260 on the handle/actuator subassembly 56 abuts the transition block outer edge 256 and is secured thereto by a bolt 262. With the bolt 262 in place, the wall of conduit 18 is captured positively between the edge 260 and the shoulders 252, 254.

The transition block 58 has through bores 264, 266, 268, 270 which, with the transition block 58 in its operative position, align with the bores 146, 148, 182 and 184, consecutively, in the cylindrical casing 132. O-rings 272 interposed between the transition block surface 244 and the casing 132 and the block edge 256 and the handle/actuator edge 260 and in surrounding relationship with each of the bores 264, 266, 268, 270, prevent leakage of fluid at the point of interconnection of the subassemblies 54, 56, 58.

The Handle/Actuator Subassembly (56).

The handle/actuator subassembly 56 consists of the grip 30, trigger 32, an air control/switching valve 274 operated by the trigger 32, and a mounting portion 276.

With the handle/actuator subassembly 56 in place, conduits 278, 280, 282, 284 in the mounting portion 276 align with the bores 264, 266, 268, 270, consecutively, in the transition block 58. The conduit 284 communicates with a pressurized supply 286 of additive, the pressure of which is on the order of 40 p.s.i. An on/off valve 288 is provided in line. With the valve 288 open, the additive flows from the supply 286 through the conduit 284, bore 270 and into the additive reservoir 192 surrounding the valve cartridge 140.

A supply of flushing solvent/water, pressurized to about 40 p.s.i., is provided at 290. An on/off valve 292 is provided for the water/solvent supply. With the valve 292 open, water/solvent from the supply 290 communicates through the conduit 282, the bore 268 and into the reservoir 190 surrounding the valve cartridge 140.

The trigger 32 controls the position of the piston 136 and thereby dictates both 1) the position of the valve wings 60, 62 and 2) whether the feed opening 198 in the actuator rod 96 is registered with the water chamber 162, so that water is discharged through the nozzle 52 to effect flushing, or whether the feed opening 198 is aligned with the additive/adhesive chamber 164, so that additive/adhesive is discharged through the nozzle 52.

The air control valve 274 consists of a stem 294 that is movable within a chamber 296 radially with respect to the conduit 18. The stem 194 has four partitions 298, 300, 302, 304, spaced lengthwise thereof, defining therebetween isolated chambers 306, 308, 310. A coil spring 312 bears on the partition 304 and normally biases the stem 294 to the FIG.

2 position. In the FIG. 2 position, pressurized air from a supply 313, at about 100 p.s.i., communicates with an inlet 314 through the chamber 308 and back through the conduit 278, bore 264 and bore 146 to the top of the piston 136, to thereby drive the piston 136 downwardly toward the FIG. 4 position. As this occurs, the air beneath the piston 136 is forced through conduit 148 into bore 266, through conduit 280 into the chamber 306, from where it is communicated through a hollow portion 316 of the stem 294 to an exhaust port 318 for appropriate discharge in the direction of arrow 320.

Release of the trigger 32 by the operator permits the coil spring 311 to drive the stem 294 back to the FIG. 2 position. As this occurs, the air from the supply 313 is directed into the chamber 308, and in turn the conduit 280, the bore 266, the bore 148 and against the chamfered edge 322 at the bottom of the piston 136. The air impinging on the edge 322 drives the piston 136 upwardly, whereupon air above the piston 136 is forced through the bore 146, the bore 164, the bore 278, through the chamber 310 and out the exhaust port 318.

It is possible to incorporate a four-way valve 324 into the trigger system so that operation of the valve can be effected selectively through the trigger 32 or a foot pedal 326 connected to the valve 324. This allows hands free operation.

Assembly and replacement of the valve 274 is facilitated by the inventive structure. With the handle/actuator subassembly 56 separated from the conduit 18, an open end 328 of the chamber 296 is exposed to permit introduction of the stem 294. The stem 294 is directed from left to right through the chamber 296 in FIG. 2 until an enlarged head 330 on the valve stem 294 is exposed in the vicinity of the trigger 32. The trigger 32 has a bifurcated end 332 dimensioned to straddle the grip 30. The trigger 32 also has a slot which accommodates a reduced diameter portion 332 of the stem 294 that is narrower than the stem head 330. To effect assembly of the trigger 32, the stem portion 332 is introduced to the trigger slot and the trigger 32 then slid up until the trigger end 332 slides over the grip 30. A hinge pin 334 is directed through both legs 336, 338 on the trigger end 332 and the intermediate grip 30.

Figure 5:
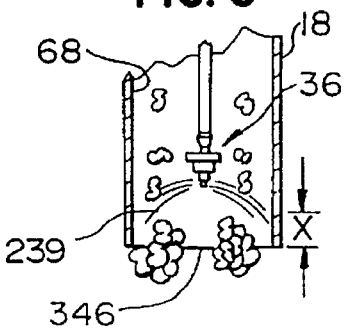
FIG. 5 is a front sectional elevation view of a discharge nozzle on the inventive system in a different relationship to the bottom of the conduit than that in FIG. 4.

Another aspect of the invention is the use of a nozzle 52 through which additive is directed radially outwardly from the center of the conduit 18 in a shower pattern that is in the configuration of an inverted cone/umbrella, as shown at 239 clearly in FIGS. 4 and 5. The nozzle 52 has an annular wall 340 with a plurality of orifices 342 therethrough and equidistantly spaced around the periphery of the wall 340 to produce a continuous fan of additive. A single layer of adhesive is developed and bends down under the influence of gravity to produce the cone/umbrella-shaped fluid discharge pattern. The pressure of the fluid and orifice diameters can be chosen so that the flow remains substantially horizontal between the nozzle 52 and conduit 18 so that there is a flat, horizontal layer of additive. It has been found that this pattern causes adequate coating. In any event, it is preferred that the effective diameter of the flow pattern be greater than the diameter of the conduit 18.

Figure 6:
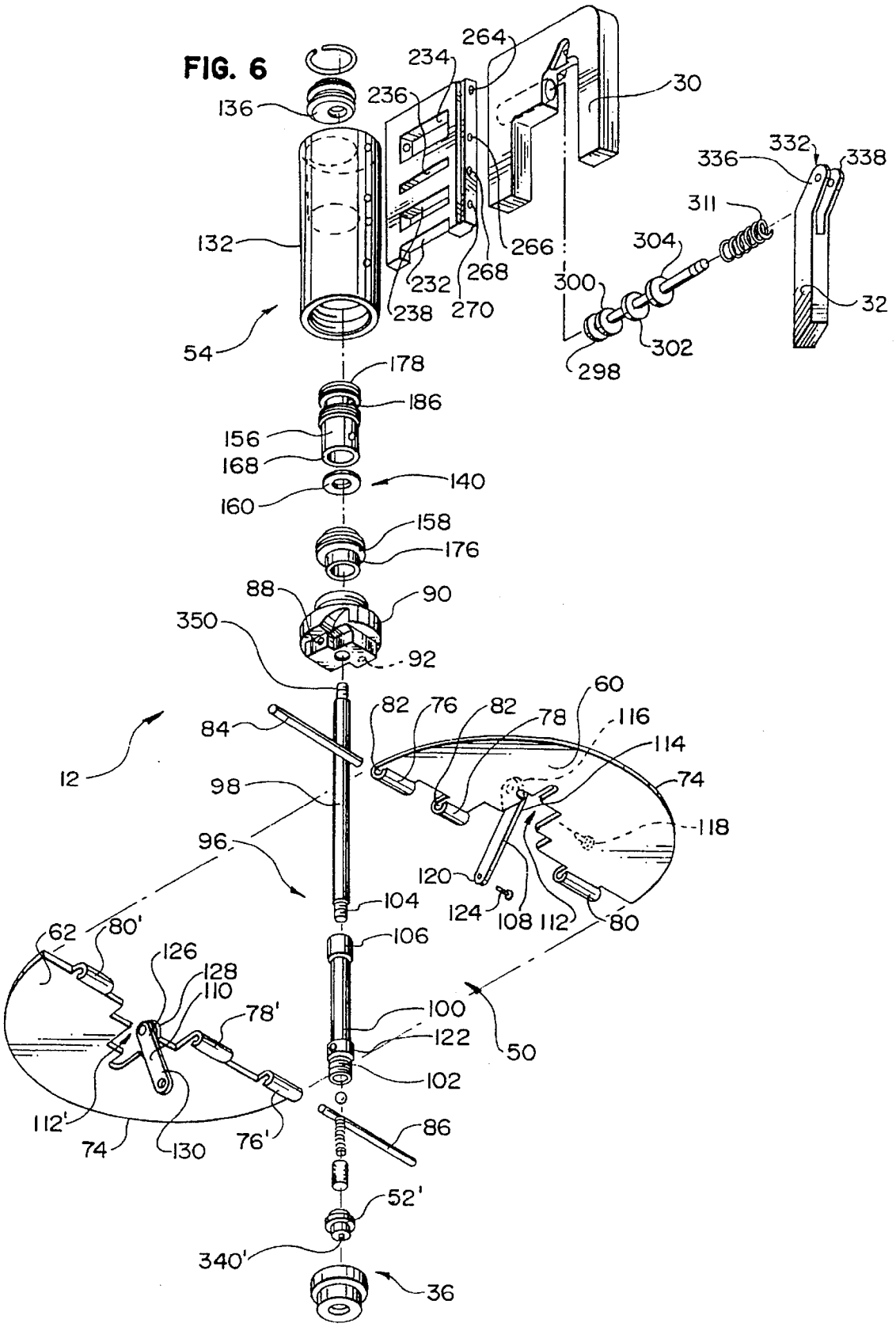
FIG. 6 is an exploded perspective view of the inventive flow control/adhesive applying system.
Figure 7:
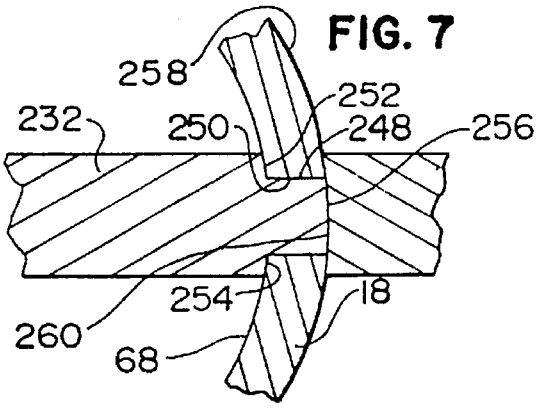
FIG. 7 is a sectional view of the connection between the inventive flow control/additive applying system and the conduit, taken along line 7—7 of FIG. 2.

A single, vertically aligned orifice 340', as shown in a modified orifice 52' in FIG. 6, also produces an adequate additive spray which is in the configuration of an inverted cone.

It should be noted that the description of the spray pattern 239 is intended to identify the configuration of the principal volume of fluid flow. There is a significant amount of overspray and low pressure spray that falls through the conduit outlet 20 in addition to the spray pattern flow.

A lock nut 344 holds the nozzle 52, 52' to the lower extremity 102 of the rod part 100. Preferably, the nozzle 52, 52' is located adjacent to the bottom edge 346 of the conduit 18. In one configuration, the shower pattern is such that at least part of the spray from the nozzle 52, 52' is propelled directly into the container 26 below the bottom edge 346 of the conduit 18. With this arrangement, not only are the conveying loose fill particles 22 subjected to the additive by reason of passing through the additive shower, but the shower in addition coats particles 22 coming to rest in the container 26.

The advantage of this configuration is that additional additive is deposited on the articles 22 and, at the same time, none of the additive impinges on the wall surface 68 of the conduit 18 as might cause additive buildup and necessitate cleaning thereof.

If it is desired that not all or none of the discharged additive be propelled directly into the container 26, the nozzle 52, 52' can be raised with respect to the conduit edge 346, as shown in FIG. 5. As can be seen in FIG. 5, the spray pattern impinges directly on the conduit wall 68. Preferably, the additive is directed against the surface 68 so that the additive impinges on the conduit 18 no more than approximately 6 inches from the bottom edge 346 of the conduit 18. This distance is identified as X in FIG. 5.

The advantage of this latter construction is that if there is any additive buildup on the wall 68, the same can be readily removed by the operator reaching through the bottom/discharge end of the conduit 18.

It has been found, unexpectedly, that partial coating of particles 22 with a film of additive is sufficient to produce a high integrity loose fill package. Tests have demonstrated that the inventive system uses on the order of only 50% of the additive used in the prior art systems. The thin film of additive dries considerably more rapidly than the heavier layers applied by the prior art devices. Shipping and handling can, therefore, proceed much sooner, which is an obvious advantage.

The present invention contemplates facilitated assembly and disassembly of the entire control/applicator 12. By releasing the bolt 262, the handle/actuator subassembly 56 can be separated from the transition block subassembly 58. This allows the transition block subassembly 58, the fluid control valve subassembly 54 and loose fill flow control valve assembly 50 to be dropped as a unit out the bottom of the conduit 18. By unscrewing the valve cap 90, the lower rod part 100 is simultaneously unscrewed from the upper rod part 98. To prevent the upper rod part 98 from turning as the valve cap 90 is unscrewed, the upper end 350 of the rod part 98 is connected to the piston 136 in an offcenter relation. That is, the piston 136 and cylinder 134 therefor are not aligned with the central axis of the cylinder casing 132.

The cartridge 140 releases from the casing 132 with the cap 90 and is readily separable therefrom for repair and/or replacement. Reassembly is effected by reversing the above-described steps. As noted previously, the cartridge 140 is a low cost item and can be easily and inexpensively replaced.

The operation of the inventive device 12 is extremely simple. One simply grasps the grip 30, positions the conduit outlet 20 where desired, and draws on the trigger 32. The valve wings 33, 34 open and simultaneously the additive discharges through the nozzle assembly 36. Release of the trigger 32 promptly arrests both loose fill 16 and fluid flow.

To flush the system, one need only open the on/off valve 292, with the system 12 in the FIG. 2 mode, for the desired length of time. Because of the simple fluid network, flushing can be completely carried out in a matter of seconds.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

Description of the Prior Art

Figure 8:
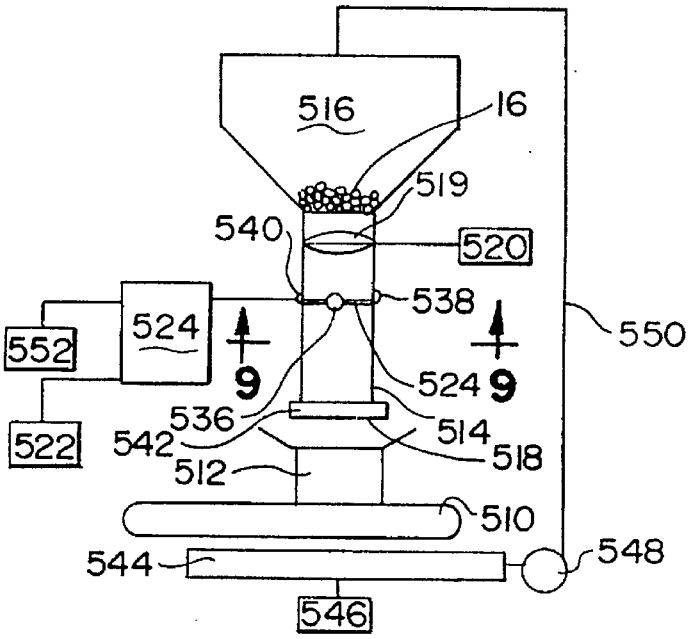
FIG. 8 PRIOR ART
FIG. 8 is a schematic, side elevation view of a prior art loose fill delivery/additive applying system.

FIG. 8 schematically depicts a state of the art loose fill dispensing/additive applying system for on-site packaging. A conveyor 510 is used to advance containers 512 one by one into a loading position under a discharge conduit 514. The conduit 514 directs loose fill 16 from a bulk supply in a hopper 516 out a discharge end 518 of the conduit 514 into the container 512. A one piece disk-like plate 518 is pivotable through an electromechanical actuator 520 between an open position, wherein the plane of the plate 518 is in vertically aligned relationship to allow passage of the loose fill through the conduit 514, and a closed position, wherein the plate 518 blocks the internal passageway defined by the conduit 514.

As the loose fill is conveyed through the conduit 514, it is coated with additive/adhesive from a supply 522. The additive/adhesive is delivered through a manifold 524 for discharge through radially inwardly directed nozzles 528, 530, 532. The nozzles 528, 530, 532 are spaced equidistantly about the periphery of the conduit 514. Sufficient pressure is developed in the manifold 524 that the additive is discharged in a high pressure, horizontal stream, which impinges against the conduit wall 534 facing the nozzles. Crossing streams from the nozzles 528, 530, 532 create turbulence that causes the loose fill particles to tumble and be substantially completely covered with additive/adhesive. The nozzles 528, 530, 532 each have an associated solenoid valve 536, 538, 540 which is activated by the control 524.

A drip trough 542 is provided on the bottom of the conduit 514 to collect excess additive/adhesive. The adhesive propelled against the conduit wall 534 tends to drip down to the trough 542, however, over time, there is a progressive build-up of the adhesive on the wall 534. The additive/adhesive collected in the trough can be selectively recycled or disposed of.

Any additive-treated loose fill that escapes over the sides of the container 512 is collected in an accumulator 544. A 220 volt heater 546 quick dries the additive/adhesive. The loose fill particles with the dried adhesive are then directed from the trough 544 by a blower 548 through a return line 550 which directs the particles back into the hopper 516 for reuse.

Figure 9:
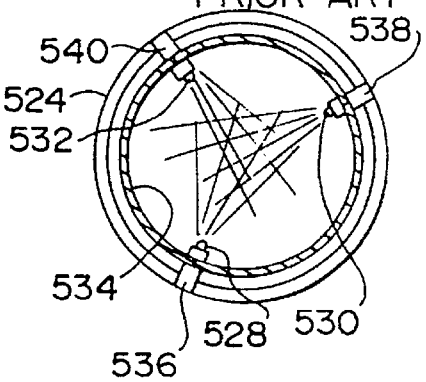
FIG. 9 PRIOR ART
FIG. 9 is a sectional view of the conduit showing three additive applying nozzles and taken along line 9—9 of FIG. 8.

When it is desired to flush the system in FIGS. 8 and 9, the control 524 is set to deliver water or other solvent from a supply 552 through the manifold 524 and to the nozzles 528, 530, 532 for a timed, several minute interval.

The electromechanical controls 520, 524 coordinate the movement of the valve plate 518 and the delivery of additive as well as the flush fluid.

I claim:

1. An apparatus for controllably delivering discrete loose fill dunnage particles from a supply thereto to a packaging site and for applying an additive to at least a portion of an exposed surface on a plurality of particles to cause abutting particles to adhere to each other, said apparatus comprising:

a conduit having an inside wall surface defining a vertical conveying path for loose fill particles, an inlet end communicating with the loose fill particle supply, and an outlet end for discharging loose fill particles conveyed from said supply through said conduit to the packaging site, said inlet end and outlet end being vertically spaced so that loose fill particles convey by gravity only between the conduit inlet and outlet ends;

means for applying an additive to the loose fill particles as they are conveying between said supply and the packaging site, said additive applying means including a substantially radially centered nozzle means for producing an umbrella-shaped shower pattern of additive through which a plurality of loose fill particles conveying between said supply and the packaging site pass; and means for delivering an additive under pressure through said nozzle means, said nozzle means having an outlet residing above the conduit outlet end and in relationship to the outlet end of the conduit so that additive is propelled from said nozzle means directly to the packaging site through the outlet end of the conduit, whereby the additive propelled directly to the packaging site does not contact the inside wall surface of the conduit to thereby reduce additive buildup on the inside wall surface of the conduit, there being an unobstructed radial path between the nozzle means and the inside wall surface of the conduit so that conveying particles can enter the additive delivered by the nozzle means immediately adjacent the nozzle means and at least part of the conveying particles are treated with additive prior to discharging from the outlet end of the conduit.

2. The apparatus for delivering loose fill and applying additive thereto according to claim 1 including a flow control valve on the conduit and having a particle blocking wall, and means for mounting the blocking wall for movement relative to the conduit selectively between (a) an open position wherein loose fill can convey freely from the supply through the conduit to the packaging site, and (b) a closed position wherein the blocking wall blocks passage of loose fill from the supply to the packaging site.

3. The apparatus for delivering loose fill and applying additive thereto according to claim 2 wherein said additive applying means includes additive control means selectively movable between (a) a closed position wherein the control means blocks the flow of additive from a supply to said nozzle means, and (b) an open position wherein additive from a supply can flow to and through the nozzle means, there being means interconnecting the blocking wall and the additive control means for moving the additive control means to its open position as an incident of the blocking wall moving from its closed position to its open position and the additive control means to its closed position as an incident of the blocking wall moving from its open position to its closed position.

4. The apparatus for delivering loose fill and applying additive thereto according to claim 2 wherein the blocking wall is pivotable between its closed position and its open position.

5. The apparatus for delivering loose fill and applying additive thereto according to claim 2 including means remote from said blocking wall for moving the blocking wall selectively between its open and closed positions.

6. The apparatus for delivering loose fill and applying additive thereto according to claim 1 wherein said conduit has a substantially cylindrical cross section with a first diameter at the inlet end of the conduit, the umbrella-shaped shower pattern has a second diameter that is greater than the first diameter.

7. An apparatus for controllably delivering discrete loose fill dunnage particles from a supply thereof to a packaging site and for applying an additive to at least a portion of an exposed surface on a plurality of particles to cause abutting particles to adhere to each other, said apparatus comprising:

a conduit having an inside wall surface defining a vertical conveying path for loose fill particles, an inlet end communicating with the loose fill particle supply, and an outlet end for discharging loose fill particles conveyed from said supply through said conduit to the packaging site, said inlet end and outlet end being vertically spaced so that loose fill particles convey by gravity only between the conduit inlet and outlet ends;

means for applying an additive to the loose fill particles as they are conveying between said supply and the packaging site, said additive applying means including a substantially radially centered nozzle means for producing an umbrella-shaped shower pattern of additive through which a plurality of loose fill particles conveying between said supply and the packaging site pass; and means for delivering an additive under pressure through said nozzle means, said nozzle means having an outlet residing above the conduit outlet end and residing in relationship to the outlet end of the conduit so that additive is propelled from said nozzle means in a pattern at the outlet end of the conduit such that least a portion of the additive in the pattern flows through the outlet end without impinging on the inside wall, there being a direct radial path between the nozzle means and the inside wall surface of the conduit so that conveying particles can enter the additive delivered by the nozzle means prior to discharging from the outlet end of the conduit.

8. The apparatus for delivering loose fill and applying additive thereto according to claim 7 wherein the nozzle means is situated relative to the conduit so that at least a portion of the additive in the pattern impinges on the conduit at the outlet end thereof.

9. The apparatus for delivering loose fill and applying additive thereto according to claim 8 wherein the nozzle means is situated relative to the conduit so that the additive pattern therefrom impinges on the conduit no higher than approximately 6 inches from the outlet end of the conduit so that access can be readily gained through the outlet end of the conduit to that portion of the conduit exposed to the additive to facilitate cleaning thereof.

10. The apparatus for delivering loose fill and applying additive thereto according to claim 8 including a flow control valve on the conduit and having a particle blocking wall, and means for mounting the blocking wall for movement relative to the conduit selectively between (a) an open position wherein loose fill can convey freely from the supply through the conduit to the packaging site, and (b) a closed position wherein the blocking wall blocks passage of loose fill from the supply to the packaging site, wherein said additive applying means includes additive control means selectively movable between (a) a closed position wherein the control means blocks the flow of additive from a supply to said nozzle means, and (b) an open position wherein additive from a supply can flow to and through the nozzle means, there being means interconnecting the blocking wall and the additive control means for moving the additive control means to its open position as an incident of the blocking wall moving from its closed position to its open position and the additive control means to its closed position as an incident of the blocking wall moving from its open position to its closed position.

11. The apparatus for delivering loose fill and applying additive thereto according to claim 8 including a pressurized supply of additive and the additive control means includes means for selectively permitting and blocking flow of additive from said additive supply to the nozzle means.

12. The apparatus for delivering loose fill and applying additive thereto according to claim 7 wherein said inside wall surface has a cylindrical configuration, the nozzle means is located centrally of the conduit within the conveying path and directs the additive radially outwardly with respect to the inside wall surface through a range of approximately 360° around the axis of the conduit.

13. The apparatus for delivering loose fill and applying additive thereto according to claim 7 wherein there is one and only one nozzle means for producing a shower of additive within said conveying path.

14. The apparatus for delivering loose fill and applying additive thereto according to claim 7 wherein said nozzle means has a conduit with a plurality of openings/orifices in an annular array for directing additive therefrom through a range of approximately 360°.

15. The apparatus for delivering loose fill and applying additive thereto according to claim 7 wherein said nozzle means comprises a conduit with a curved wall and a plurality of openings are provided in said curved wall in circumferentially spaced relationship to produce a fan of additive from said nozzle means.

16. The apparatus for delivering loose fill and applying additive thereto according to claim 15 wherein there is one and only one nozzle means.

17. The apparatus for delivering loose fill and applying additive thereto according to claim 15 wherein each said opening in said curved wall has a lengthwise axis and the axes of all said openings in said curved wall of the nozzle means are substantially co-planar.

18. The apparatus for delivering loose fill and applying additive thereto according to claim 7 wherein said nozzle means has a single orifice.

19. The apparatus for delivering loose fill and applying additive thereto according to claim 18 wherein said single orifice comprises a vertically extending bore in the nozzle means.

20. An apparatus for controllably delivering discrete loose fill dunnage particles from a supply thereof to a packaging site and for applying an additive to at least a portion of an exposed surface on a plurality of particles to cause abutting particles to adhere to each other, said apparatus comprising:

a conduit having an inside wall surface defining a vertical conveying path for loose fill particles, an inlet end communicating with the loose fill particle supply, and an outlet end for discharging loose fill particles conveyed from said supply through said conduit to the packaging site, said inlet end and outlet end being vertically spaced so that loose fill particles convey by gravity only between the conduit inlet and outlet ends;

means for applying an additive to the loose fill particles as they are conveying between said supply and the packaging site, said additive applying means including a substantially radially centered nozzle means for producing an umbrella-shaped shower pattern of additive through which a plurality of loose fill particles conveying between said supply and the packaging site pass; and means for delivering an additive under pressure through said nozzle means, said nozzle means having an outlet residing above the conduit outlet end and residing in relationship to the outlet end of the conduit so that additive is propelled from said nozzle means directly against the inside wall surface of the conduit at the outlet end of the conduit and so that at least part of the conveying particles are treated with additive prior to discharging from the outlet end of the conduit.

21. A mechanical apparatus for controllably delivering discrete loose fill dunnage particles from a supply to a packaging site and for applying an adhesive to at least a portion of an exposed surface of a plurality of particles to cause abutting particles to adhere to each other, said mechanical apparatus comprising:

a conduit having an inside wall surface defining a vertical conveying path for loose fill particles, an inlet end communicating with the loose fill particle supply, and an outlet end for discharging loose fill particles conveyed from said supply through said conduit to the packaging site, said inlet end and outlet end being vertically spaced so that loose fill particles convey by gravity only between the conduit inlet and outlet ends;

means from applying an adhesive to the loose fill particles as they are conveying between said supply and the packaging site, said additive applying means including a nozzle means for producing an umbrella-shaped shower pattern of additive through which a plurality of loose fill particles conveying between said supply and the packaging site pass;

means for delivering an additive under pressure through said nozzle means, said nozzle means residing radially centrally of said conduit and directing additive under pressure from a point above the conduit outlet end outwardly toward said inside wall surface; and a mechanically actuated flow control valve on the conduit and having a particle blocking wall, and means for mounting the blocking wall for movement relative to the conduit selectively between (a) an open position wherein loose fill can convey freely from the supply through the conduit to the packaging site, and (b) a closed position wherein the blocking wall blocks passage of loose fill from the supply to the packaging site, wherein said additive applying means includes additive control means selectively movable between (a) a closed position wherein the control means blocks the flow of additive from a supply to said nozzle means, and (b) an open position wherein additive from a supply can flow to and through the nozzle means, there being means interconnecting the blocking wall and the additive control means for moving the additive control means to its open position as an incident of the blocking wall moving from its closed position to its open position and the additive control means to its closed position as an incident of the blocking wall moving from its open position to its closed position, there being a direct radial path between the nozzle means and the inside wall surface of the conduit so that conveying particles enter the additive delivered by the nozzle means prior to discharging from the outlet end of the conduit.

* * * * *